US010182621B2

(12) United States Patent
Holt

(10) Patent No.: US 10,182,621 B2
(45) Date of Patent: Jan. 22, 2019

(54) PROTECTIVE FOOT COVERING DEVICE

(71) Applicant: Steven D. Holt, Vancouver, WA (US)

(72) Inventor: Steven D. Holt, Vancouver, WA (US)

( * ) Notice: Subject to any disclaimer, the term of this patent is extended or adjusted under 35 U.S.C. 154(b) by 612 days.

(21) Appl. No.: 14/252,242

(22) Filed: Apr. 14, 2014

(65) Prior Publication Data

US 2015/0289580 A1 Oct. 15, 2015

(51) Int. Cl.

| | |
|---|---|
| ***A43B 1/02*** | (2006.01) |
| ***A43C 11/14*** | (2006.01) |
| ***A43B 3/02*** | (2006.01) |
| ***A43C 11/12*** | (2006.01) |
| ***A43B 1/00*** | (2006.01) |
| ***A43B 7/12*** | (2006.01) |

(52) U.S. Cl.

CPC ..... *A43C 11/1493* (2013.01); *A43B 1/0081* (2013.01); *A43B 3/02* (2013.01); *A43B 7/12* (2013.01); *A43C 11/12* (2013.01)

(58) Field of Classification Search

CPC .... A43B 3/02; A43B 3/08; A43B 3/24; A43B 3/242; A43B 1/0081; A43C 11/12; A43C 11/1493

USPC .... 36/8.1, 8.3, 1.5, 50.1, 4, 138, 7.3, 83, 84

See application file for complete search history.

(56) References Cited

U.S. PATENT DOCUMENTS

| | | | | | |
|---|---|---|---|---|---|
| 90,197 | A * | 5/1869 | Rogers | 36/2.6 | |
| 237,667 | A * | 2/1881 | Beattie | 36/1 | |
| 1,637,027 | A * | 7/1927 | Piper | A43B 3/16 12/142 EV | |
| 2,129,226 | A * | 9/1938 | Montano | A43B 5/08 36/8.1 | |
| 2,302,596 | A * | 11/1942 | Bigio | 36/101 | |
| 2,305,926 | A | 12/1942 | Kohler | | |
| 3,640,006 | A | 2/1972 | Kendrick | | |
| 3,824,716 | A | 7/1974 | Di Paolo | | |
| 4,599,812 | A * | 7/1986 | Harmsen | 36/1.5 | |
| 4,628,622 | A * | 12/1986 | McBarron | 36/50.1 | |
| 4,713,895 | A * | 12/1987 | Vallieres | A43B 3/24 36/1.5 | |
| D303,729 | S | 10/1989 | Macasieb | | |
| 4,882,858 | A * | 11/1989 | Signori | 36/131 | |
| 4,896,437 | A * | 1/1990 | Johnson | 36/1.5 | |
| 4,976,049 | A | 12/1990 | Myers | | |
| 5,371,958 | A | 12/1994 | Brosseau | | |
| 5,394,624 | A | 3/1995 | Siepser | | |
| 6,185,845 | B1 * | 2/2001 | Gordon | 36/7.1 R | |
| 6,526,920 | B1 * | 3/2003 | Griffin | 119/850 | |
| 6,973,742 | B2 * | 12/2005 | Gordon | 36/7.1 R | |

(Continued)

*Primary Examiner* — Katharine Gracz

(57) ABSTRACT

A protective foot covering device keeps a wearer's foot dry, particularly while showering. The device includes a boot having an upper end, a lower end and a perimeter wall coupled to and extending between the upper and lower ends. The upper end includes a peripheral edge defining an access opening into a hollow interior of the boot. The boot further includes a shaft and a vamp. The shaft is coupled to and extends downwardly from the peripheral edge. The vamp is coupled to and extends forwardly from the shaft toward a toe of the boot. The boot has a slit extending therein defining first and second overlapping sections extending through the shaft downwardly from the upper end. A sole is coupled to and covers the lower end. A coupler is attached to the boot and removably couples the first and second overlapping sections together to close the slit.

12 Claims, 3 Drawing Sheets

(56) References Cited

U.S. PATENT DOCUMENTS

| | | | | |
|---|---|---|---|---|
| 7,237,345 | B2 | 7/2007 | Thomas | |
| 7,310,894 | B1 | 12/2007 | Schwarzman et al. | |
| 8,113,152 | B1 * | 2/2012 | Paxton et al. | 119/850 |
| 2004/0118019 | A1 * | 6/2004 | Ito | A43B 1/0027 36/50.1 |
| 2004/0215118 | A1 | 10/2004 | Dumas et al. | |
| 2006/0117598 | A1 * | 6/2006 | Czaplewski et al. | 36/2 R |
| 2007/0017126 | A1 * | 1/2007 | Kipnes et al. | 36/101 |
| 2007/0033837 | A1 * | 2/2007 | Fulton | 36/59 R |
| 2008/0229613 | A1 * | 9/2008 | Park | 36/50.1 |
| 2009/0217552 | A1 * | 9/2009 | Paintin et al. | 36/138 |

* cited by examiner

PROTECTIVE FOOT COVERING DEVICE

BACKGROUND OF THE DISCLOSURE

Field of the Disclosure

The disclosure relates to foot covering devices and more particularly pertains to a new foot covering device for keeping a wearer's foot dry, particularly while showering.

SUMMARY OF THE DISCLOSURE

An embodiment of the disclosure meets the needs presented above by generally comprising a boot having an upper end, a lower end and a perimeter wall coupled to and extending between the upper and lower ends. The upper end includes a peripheral edge defining an access opening into a hollow interior of the boot. The boot further includes a shaft and a vamp. The shaft is coupled to and extends downwardly from the peripheral edge. The vamp is coupled to and extends forwardly from the shaft toward a toe of the boot. The boot has a slit extending therein defining first and second overlapping sections extending through the shaft downwardly from the upper end. A sole is coupled to and covers the lower end. A coupler is attached to the boot and removably couples the first and second overlapping sections together to close the slit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
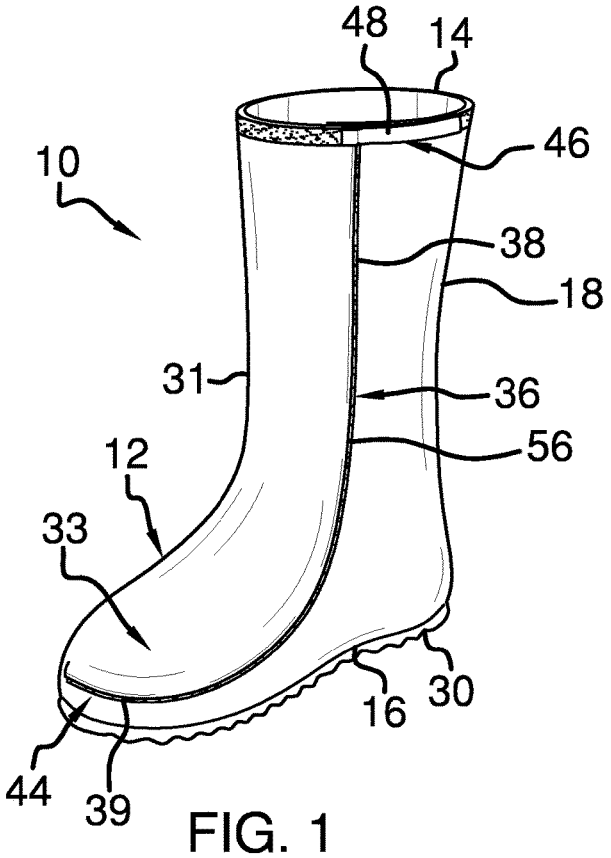
FIG. 1 is a top front side perspective view of a protective foot covering device according to an embodiment of the disclosure.
Figure 2:
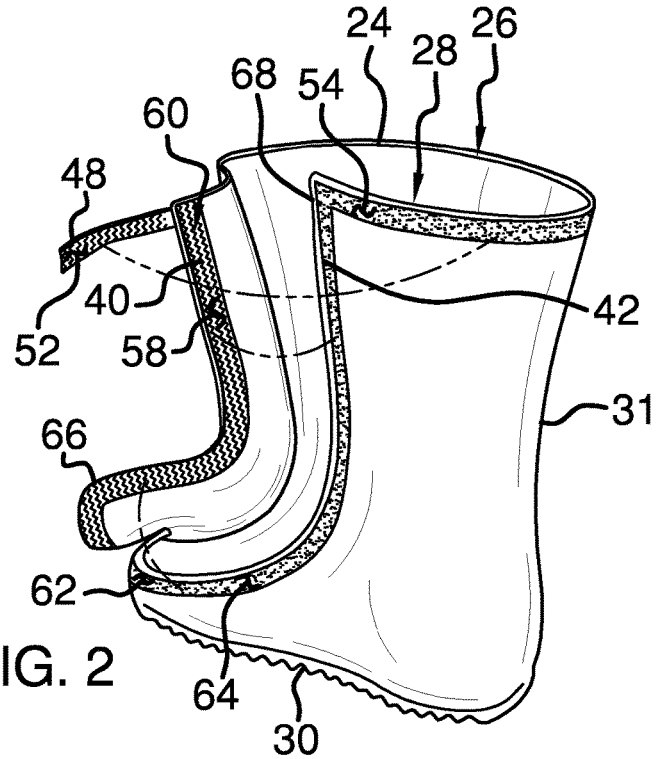
FIG. 2 is a top rear side perspective view of an embodiment of the disclosure.
Figure 3:
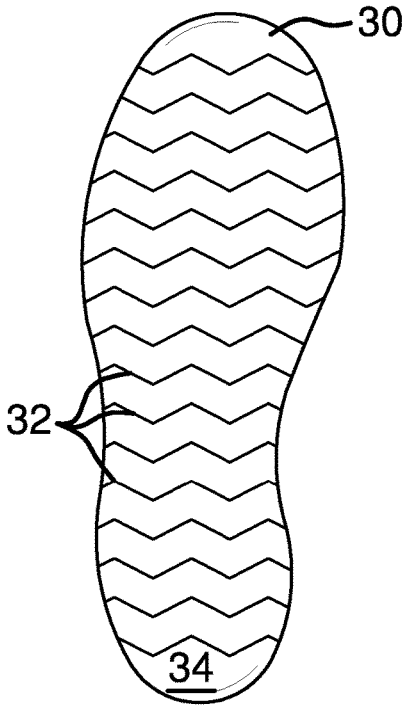
FIG. 3 is a bottom view of an embodiment of the disclosure.
Figure 4:
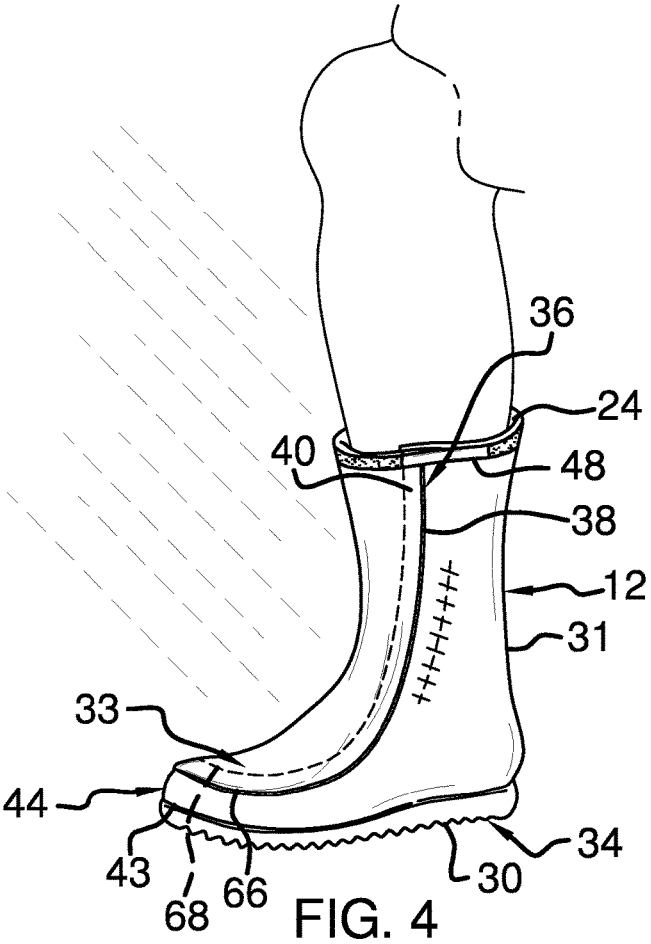
FIG. 4 is an in-use side perspective view of an embodiment of the disclosure.

With reference now to the drawings, and in particular to FIGS. 1 through 5 thereof, a new foot covering device embodying the principles and concepts of an embodiment of the disclosure and generally designated by the reference numeral 10 will be described.

As best illustrated in FIGS. 1 through 5, the protective foot covering device 10 generally comprises a boot 12 having an upper end 14, a lower end 16 and a perimeter wall 18 coupled to and extending between the upper end 14 and the lower end 16. The perimeter wall 18 includes a first lateral side 20 and a second lateral side 22. The upper end 14 of the boot 12 includes a peripheral edge 24 defining an access opening 26 into a hollow interior 28 of the boot 12. The boot 12 may be comprised of a waterproof material, such as plastic, rubber or the like, in order to ensure that the wearer's foot remains dry. The boot 12 further includes a shaft 31 and a vamp 33. The shaft 31 is coupled to and extends downwardly from the peripheral edge 24 such that the shaft 31 is configured to cover the wearer's ankle as well as that portion of the wearer's leg that is positioned within the boot 12. The vamp 33 is coupled to and extends forwardly from the shaft 12 toward a toe 44 of the boot 12. In this manner, the vamp 33 is configured to cover the top portion of the wearer's foot extending from the leg to the user's toes. A sole 30 is coupled to and covers the lower end 16 of the boot 12. The sole 30 may be comprised of a non-slip material, such as rubber or the like. The sole 30 may further have a plurality of ridges 32 positioned on a bottom surface 34 of the sole 30.

The boot 12 has a slit 36 extending therein. The slit 36 defines first 40 and second 42 overlapping sections of the boot 12 extending through the shaft 31 and downwardly from the upper end 14. An upper section 38 of the slit 36 may extend though the first lateral side 20 of the boot 12. The slit 36 may have a lower section 39 that extends from the upper section 38 of the slit 36 toward the toe 44 of the boot 12. The lower section 39 of the slit 36 may extend from the first lateral side 20 toward the second lateral side 22 proximate the toe 44 of the boot 12.

Figure 5:
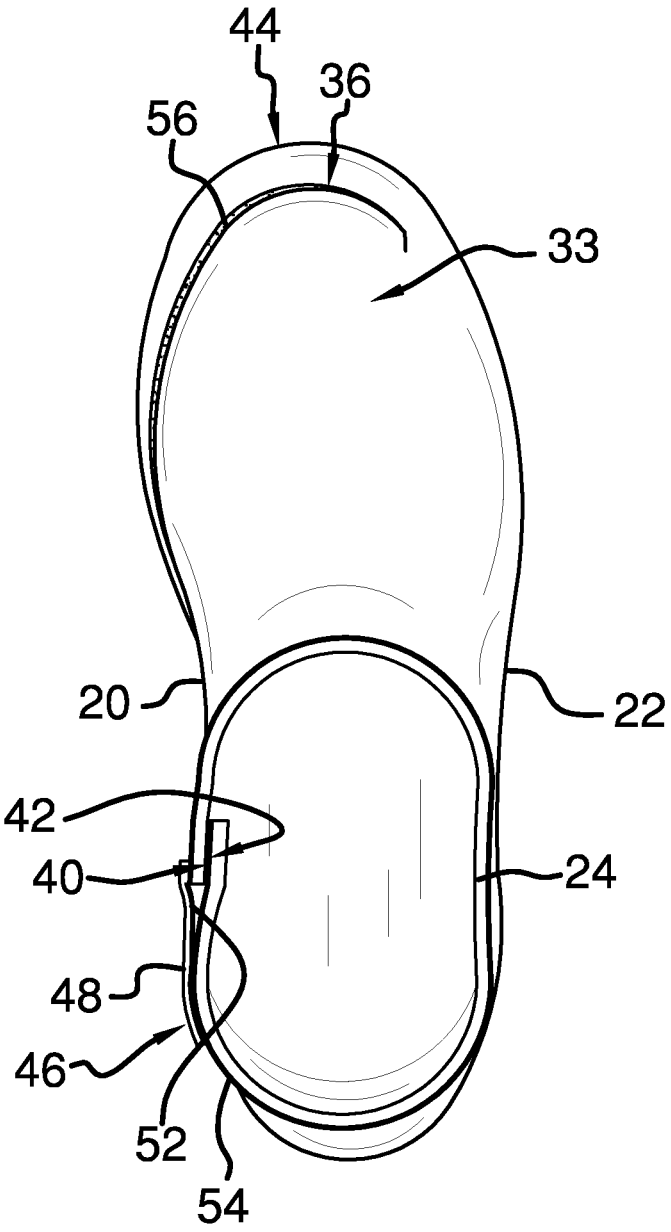
FIG. 5 is a top view of an embodiment of the disclosure.

A closure 46 is attached to the peripheral edge 24 for closing the slit 36 at the peripheral edge 24. The closure 46 may include a strap 48 and a fastener 50. The strap 48 is attached to the peripheral edge 24. The fastener 50 includes first 52 and second 54 complementary portions wherein the first complementary portion 52 of the fastener 50 is attached to the strap 48 and the second complementary portion 54 of the fastener 50 is attached to and extends around the peripheral edge 24 of the upper end 14. More particularly, the second complementary portion 54 of the fastener 50 may extend substantially around an entirety of the peripheral edge 24, as shown in FIG. 5. The closure 46 may comprise a hook and loop fastener. The closure 46 will help to prevent water from seeping into the boot 12 through the upper end 14.

A coupler 56 is attached to the boot 12. The coupler 56 removably couples the first 40 and second 42 overlapping sections together to close the slit 36. The coupler 56 comprises a first mating member 58 attached to an inner surface 60 of the first overlapping section 40 and a second mating member 62 attached to an exterior surface 64 of the second overlapping section 42. The first 58 and second 62 mating members are engageable to close the slit 36. The coupler 56 may comprise a hook and loop coupler. Each of the first 58 and second 62 mating members is positioned proximate an end edge 66, 68 of an associated one of the first 40 and second 42 overlapping sections of the boot 12. Each of the first 40 and second 42 mating members may extend an entire length along the end edges 66, 68 of the associated first 40 and second 42 overlapping sections.

In use, as stated above and shown in the Figures, the first 40 and second 42 overlapping sections are moved away from each other to allow a wearer to place his or her foot within the hollow interior 28 of the boot 12. The location and size of the slit 36 permits the user to open the boot 12 relatively widely in order to facilitate placement of the foot into the boot 12. The slit 36 is then closed using closure 46 and coupler 56 to ensure that the boot 12 is securely fitted around the wearer's foot. The waterproof nature of the boot 12 allows the wearer to shower while keeping his or her foot from getting wet.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A protective foot covering device comprising:

a boot having an upper end, a lower end and a perimeter wall coupled to and extending between said upper end and said lower end, said upper end of said boot including a peripheral edge defining an access opening into a hollow interior of said boot, said boot further including a shaft and a vamp, said shaft being coupled to and extending downwardly from said peripheral edge, said vamp being coupled to and extending forwardly from said shaft toward a toe of said boot;

said boot having a slit extending therein, said slit defining first and second overlapping sections of said boot extending through said shaft and downwardly from said upper end, said slit extending through said peripheral edge of said upper end;

a sole coupled to and covering said lower end of said boot; and a coupler attached to said boot, said coupler removably coupling said first and second overlapping sections together to close said slit;

a closure being attached to said boot flush with said peripheral edge for closing said slit at said peripheral edge wherein said closure is configured for holding said peripheral edge against a leg inserted into said boot, said closure including a strap and a fastener, said strap being attached to said peripheral edge, said fastener including first and second complementary portions, said first complementary portion of said fastener being attached to said strap, said second complementary portion of said fastener being attached to and extending around said peripheral edge of said upper end, said closure comprising a hook and loop fastener.

2. The device of claim 1, further comprising wherein said coupler comprises a first mating member attached to an inner surface of said first overlapping section and a second mating member attached to an exterior surface of said second overlapping section, said first and second mating members being engageable to close said slit.

3. The device of claim 1, further comprising wherein said coupler comprises a hook and loop coupler.

4. The device of claim 2, further comprising wherein each of said first and second mating members is positioned proximate an end edge of an associated one of said first and second overlapping sections of said boot, each of said first and second mating members extending an entire length along said end edges of said associated first and second overlapping sections.

5. The device of claim 1, further comprising said sole being comprised of a non-slip material.

6. The device of claim 1, further comprising wherein said sole has a plurality of ridges positioned on a bottom surface of said sole.

7. The device of claim 1, further comprising wherein said second complementary portion of said fastener extends substantially around an entirety of said peripheral edge of said upper end.

8. The device of claim 1, further comprising wherein said perimeter wall includes a first lateral side and a second lateral side, an upper section of said slit extending though said first lateral side.

9. The device of claim 8, further comprising wherein said slit has a lower section extending from said upper section of said slit toward said toe of said boot.

10. The device of claim 9, further comprising wherein said lower section of said slit extends from said first lateral side toward said second lateral side proximate said toe of said boot.

11. The device of claim 1, further comprising said boot being comprised of a waterproof material.

12. A protective foot covering device comprising:

a boot having an upper end, a lower end and a perimeter wall coupled to and extending between said upper end and said lower end, said perimeter wall including a first lateral side and a second lateral side, said upper end of said boot including a peripheral edge defining an access opening into a hollow interior of said boot, said boot being comprised of a waterproof material, said boot further including a shaft and a vamp, said shaft being coupled to and extending downwardly from said peripheral edge, said vamp being coupled to and extending forwardly from said shaft toward a toe of said boot;

said boot having a slit extending therein, said slit defining first and second overlapping sections of said boot extending through said shaft downwardly from said upper end, said slit extending through said peripheral edge of said upper end, an upper section of said slit extending though said first lateral side, said slit having a lower section extending from said upper section of said slit toward said toe of said boot, said lower section of said slit extending from said first lateral side toward said second lateral side proximate said toe of said boot;

a closure being attached to said boot flush with said peripheral edge for closing said slit at said peripheral edge wherein said closure is configured for holding said peripheral edge against a leg inserted into said boot, said closure including a strap and a fastener, said strap being attached to said peripheral edge, said fastener including first and second complementary portions, said first complementary portion of said fastener being attached to said strap, said second complementary portion of said fastener being attached to and extending around said peripheral edge of said upper end, said closure comprising a hook and loop fastener, said second complementary portion of said fastener extending substantially around an entirety of said peripheral edge of said upper end;

a sole coupled to and covering said lower end of said boot, said sole being comprised of a non-slip material, said sole having a plurality of ridges positioned on a bottom surface of said sole; and a coupler attached to said boot, said coupler removably coupling said first and second overlapping sections together to close said slit, said coupler comprising a first mating member attached to an inner surface of said first overlapping section and a second mating member attached to an exterior surface of said second overlapping section, said first and second mating members being engageable to close said slit, said coupler comprising a hook and loop coupler, each of said first and second mating members being positioned proximate an end edge of an associated one of said first and second overlapping sections of said boot, each of said first and second mating members extending an entire length along said end edges of said associated first and second overlapping sections.

* * * * *